US008558778B2

(12) United States Patent
Yoshii et al.

(10) Patent No.: US 8,558,778 B2
(45) Date of Patent: Oct. 15, 2013

(54) SHIFT REGISTER, SCANNING-LINE DRIVE CIRCUIT, DATA-LINE DRIVE CIRCUIT, ELECTRO-OPTICAL DEVICE, AND ELECTRONIC APPARATUS

(75) Inventors: Takashi Yoshii, Matsumoto (JP); Yukiya Hirabayashi, Yurihama-cho (JP); Koji Shimizu, Matsumoto (JP)

(73) Assignee: Epson Imaging Devices Corporation, Azumino-Shi (JP)

( * ) Notice: Subject to any disclaimer, the term of this patent is extended or adjusted under 35 U.S.C. 154(b) by 231 days.

(21) Appl. No.: 13/049,219

(22) Filed: Mar. 16, 2011

(65) Prior Publication Data

US 2011/0234554 A1 Sep. 29, 2011

(30) Foreign Application Priority Data

Mar. 26, 2010 (JP) ..... 2010-072345

(51) Int. Cl.
*G09G 3/36* (2006.01)

(52) U.S. Cl.
USPC ..... 345/100

(58) Field of Classification Search
USPC ..... 345/87–104
See application file for complete search history.

(56) References Cited

U.S. PATENT DOCUMENTS

| | | | | |
|---|---|---|---|---|
| 6,295,046 | B1 * | 9/2001 | Hebiguchi | 345/100 |
| 2002/0149318 | A1 | 10/2002 | Jeon et al. | |
| 2004/0090412 | A1 | 5/2004 | Jeon et al. | |
| 2004/0189584 | A1 * | 9/2004 | Moon | 345/100 |
| 2007/0001987 | A1 * | 1/2007 | Chun et al. | 345/100 |
| 2007/0195053 | A1 * | 8/2007 | Tobita et al. | 345/100 |
| 2008/0001904 | A1 * | 1/2008 | Kim et al. | 345/100 |
| 2010/0039363 | A1 * | 2/2010 | Lee et al. | 345/100 |

FOREIGN PATENT DOCUMENTS

JP B2-4083581 2/2008

* cited by examiner

*Primary Examiner* — Chanh Nguyen
*Assistant Examiner* — Sanghyuk Park
(74) *Attorney, Agent, or Firm* — Oliff & Berridge, PLC

(57) ABSTRACT

A shift register including a plurality of unit circuits sequentially transfers a start signal supplied to a first one of the unit circuits. Each unit circuit includes a clock terminal, an inverted clock terminal, a control terminal to which an output signal output from the output terminal of a subsequent unit circuit is supplied, a power supply terminal, a first transistor disposed between the clock terminal and the output terminal, a second transistor disposed between the output terminal and the power supply terminal, a capacitor, and a controller that supplies the start signal or the output signal of a previous unit circuit to the gate of the first transistor, and that controls the first transistor to be turned OFF later than a time at which the output signal of the subsequent unit circuit is supplied to the control terminal.

10 Claims, 9 Drawing Sheets

| | Tr5 | Tr6 | Tr7 | Tr8 | Tr3 |
|---|---|---|---|---|---|
| G(n+1): LOW | ON | OFF | ON | ON | OFF |
| G(n+1): HIGH | ON | OFF ↓ ON | ON | ON ↓ OFF | OFF ↓ ON |

SHIFT REGISTER, SCANNING-LINE DRIVE CIRCUIT, DATA-LINE DRIVE CIRCUIT, ELECTRO-OPTICAL DEVICE, AND ELECTRONIC APPARATUS

BACKGROUND

1. Technical Field

The present invention relates to a shift register, a scanning-line drive circuit, a data-line drive circuit, an electro-optical device, and an electronic apparatus.

2. Related Art

Electro-optical devices that perform display by utilizing liquid crystals or organic electronic-luminescence (EL) are widely known. In such an electro-optical device, a scanning-line drive circuit includes a shift register and generates scanning signals for sequentially selecting a plurality of scanning lines. Some of such shift registers include transistors having the same conductivity type and operate in response to two-phase clock signals. An example of such shift registers is disclosed in Japanese Patent No. 4,083,581.

FIG. 13 is a block diagram illustrating the configuration of a shift register 200 operating in response to two-phase clock signals. When a start pulse signal STV is input to a first unit circuit 210-1, the shift register 200 sequentially shifts and outputs output signals G.

FIG. 14 is a circuit diagram illustrating an example of the configuration of a unit circuit 210. The unit circuit 210 includes, as shown in FIG. 14, a pull-up transistor PUTr, a pull-down transistor PDTr, a capacitor C1, and a nodeA controller 212. The nodeA controller 212 includes transistors Tr3 and Tr4 and controls the potential of the gate (hereinafter referred to as the "nodeA") of the pull-up transistor PUTr.

FIG. 15 is a timing chart illustrating the operation of the unit circuit 210. The period F1 is the initial state in which the pull-up transistors PUTr and the pull-down transistor PDTr are OFF.

At time t1, an inverted clock signal CLKB shifts from a low level to a high level to turn ON the pull-down transistor PDTr. Then, a power supply potential VGL is supplied to one terminal of the capacitor C1. At this time, the start pulse signal STV or an output signal G(n−1) of the previous unit circuit 210-($n$−1) is at a high level so that the transistor Tr4 is turned ON. Accordingly, a current is supplied to the other terminal of the capacitor C1 so that charging of the capacitor C1 is started. Then, the potential of the nodeA increases. At this stage, the potential of the nodeA exceeds the threshold voltage of the pull-up transistor PUTr so that the pull-up transistor PUTT is turned ON.

Then, at time t2, the start pulse signal STV or the output signal G(n−1) of the previous unit circuit 210-($n$−1) is made to have a low level so that the transistor Tr4 is turned OFF. The inverted clock signal CLKB is also made to have a low level, causing the pull-down transistor PDTr to turn OFF. At this time, since the potential of the nodeA exceeds the threshold of the pull-up transistor PUTr, the pull-up transistor PUTr remains in the ON state. Since the clock signal CLK is at a high level at time t2, the potential of an output terminal OT increases. Then, the potential of the nodeA rises due to bootstrapping to such a degree that it exceeds the high level of the clock signal CLK. This makes it possible to match the high level of the output signal G(n) to that of the clock signal CLK.

Then, at time t3, the inverted clock signal CLKB is made to have a high level so that the pull-down transistor PDTr is turned ON. Then, the output signal G(n) is made to have a low level. The output signal G(n+1) of the subsequent unit circuit 210-($n$+1) is input as a control signal to the unit circuit 210($n$) so that the transistor Tr3 is turned ON. This starts the discharging of the capacitor C1 so that the potential of the nodeA is made to have a low level.

In one cycle of the shift operations of the shift register 200, the pull-up transistor PUTr performs, as shown in FIG. 15, one ON/OFF operation to change the output signal G(n) to a high level. In contrast, the pull-down transistor PDTr repeats the ON/OFF operations in synchronization with the inverted clock signal CLKB. Additionally, the period during which the pull-down transistor PDTr is ON is longer than that during which the pull-up transistor PUTr is ON. This causes the deterioration of the pull-down transistor PDTr to occur more rapidly than the pull-up transistor PUTT.

The deterioration of the pull-down transistor PDTr increases the ON resistance of the pull-down transistor PDTr. The potential of the output signal G(n) changes in response to a time constant given by, for example, a load connected to the output terminal OT or the ON resistance of the pull-down transistor PDTr. The increased ON resistance due to the deterioration over time induces the following phenomenon. When the pull-down transistor PDTr is turned ON at time t3, the output signal G(n) does not drop immediately to a low level, thereby causing rounding of the falling edge of the output signal G(n), as indicated by the dotted lines shown in FIG. 15. This generates a period dT during which both the output signal G(n) and the subsequent output signal G(n+1) are made to have a high level. This may bring about erroneous operations or quality deterioration in a device using the shift register 200.

SUMMARY

An advantage of some aspects of the invention is that it provides a shift register that includes unit circuits for switching output levels of output signals by the operations of first and second transistors and that maintains correct switching of output levels even if the second transistor deteriorates.

According to an aspect of the invention, there is provided a shift register including a plurality of unit circuits connected in series. Each of the plurality of unit circuits includes an input terminal and an output terminal. The shift register sequentially transfers a start signal supplied to the input terminal of a first one of the unit circuits in synchronization with a clock signal and an inverted clock signal whose phases are opposite to each other. Each of the plurality of unit circuits includes a first control terminal to which the clock signal is supplied, a second control terminal to which the inverted clock signal is supplied, a third control terminal to which an output signal output from the output terminal of a subsequent unit circuit is supplied, a power supply terminal to which a power supply potential is supplied, a first transistor disposed between the first control terminal and the output terminal, a second transistor disposed between the output terminal and the power supply terminal and connected at its gate to the second control terminal, a first capacitor disposed between the output terminal and a gate of the first transistor, and a controller. The controller supplies the start signal or the output signal of a previous unit circuit supplied through the input terminal to the gate of the first transistor so as to connect the first control terminal to the output terminal. The controller also supplies the output signal of the subsequent unit circuit input to the third control terminal to the gate of the first transistor later than a time at which the output signal of the subsequent unit circuit is supplied to the third control terminal so as to connect the first control terminal and the power supply terminal to the output terminal.

According to this aspect of the invention, the first transistor is turned from ON to OFF later than a time at which the output signal of the subsequent unit circuit is supplied. Accordingly, the first transistor remains ON at the time at which the clock signal drops to a low level, thereby maintaining the continuity between the output terminal and the first control terminal. Thus, a high-level output signal can drop immediately to a low level, simultaneously with the falling of the clock signal. Accordingly, correct switching of the output levels can be implemented even if the second transistor deteriorates. This prevents the occurrence of a period during which both the output signal of a current unit circuit and the output signal of the subsequent unit circuit are made to have a high level, thereby preventing the occurrence of erroneous operations. The aforementioned time at which the output signal of the subsequent unit circuit is supplied is the time at which the output signal of the subsequent unit circuit shifts from the non-active state to the active state.

In the above-stated aspect of the invention, the first transistor may correspond to a pull-up transistor PUTr in the following embodiments, while the second transistor may correspond to a pull-down transistor PDTr in the following embodiments.

The controller may include a third transistor and a time constant circuit. The third transistor may connect the gate of the first transistor to the power supply terminal when the output signal of the subsequent unit circuit is supplied to the gate of the third transistor. The time constant circuit may be disposed between the gate of the first transistor and the third transistor. More specifically, the time constant circuit may include a second capacitor and a resistor. The second capacitor may be connected at its one electrode to the gate of the first transistor and may receive a fixed potential at the other electrode. The resistor may be disposed between the third transistor and the gate of the first transistor.

Due to the provision of the time constant circuit, when the third transistor is turned ON in the state in which the first capacitor is charged, the gate potential of the first transistor gradually drops. Accordingly, the first transistor can remain ON at a time when the clock signal drops to a low level. In the above-stated aspect of the invention, the third transistor may correspond to a transistor Tri in the following embodiments.

Alternatively, the controller may include a third transistor and a delay circuit. The third transistor may connect the gate of the first transistor to the power supply terminal when the output signal of the subsequent unit circuit is supplied to the gate of the third transistor. The delay circuit may be disposed between the gate of the third transistor and the third control terminal. More specifically, the delay circuit may include an even-numbered plurality of multistage-connected inverters.

The delay circuit delays the output signal of the subsequent unit circuit supplied to the third control terminal for a predetermined time, and then supplies the output signal to the gate of the third transistor. This delays the start time of discharging of the first capacitor. Accordingly, the first transistor can remain ON even when the clock signal drops to a low level.

The first capacitor may be formed of stray capacitance of the first transistor or may include the stray capacitance.

According to another aspect of the invention, there is provided a scanning-line drive circuit used in an electro-optical device. The electro-optical device includes a plurality of scanning lines, a plurality of data lines, and electro-optical elements disposed in correspondence with the intersections of the scanning lines and the data lines. The scanning-line drive circuit includes the above-stated shift register. The scanning-line drive circuit generates, on the basis of the output signals generated by transferring the start signal by using the shift register, a plurality of scanning signals for sequentially selecting the plurality of scanning lines exclusively. With this configuration, it is possible to provide a scanning-line drive circuit having high reliability without causing the occurrence of erroneous operations.

According to still another aspect of the invention, there is provided a data-line drive circuit used in an electro-optical device. The electro-optical device includes a plurality of scanning lines, a plurality of data lines, and electro-optical elements disposed in correspondence with the intersections of the scanning lines and the data lines. The data-line drive circuit includes the above-described shift register. The data-line drive circuit generates, on the basis of the output signals generated by transferring the start signal by using the shift register, a plurality of data-line selecting signals for sequentially selecting the plurality of data lines exclusively. With this configuration, it is possible to provide a data-line drive circuit having high reliability without causing the occurrence of erroneous operations.

According to a further aspect of the invention, there is provided an electro-optical device including a plurality of scanning lines, a plurality of data lines, electro-optical elements disposed in correspondence with the intersections of the scanning lines and the data lines, and the above-stated scanning-line drive circuit or data-line drive circuit. With this configuration, highly reliable driving operations can be implemented while preventing the occurrence of erroneous operations. The above-described electro-optical device is particularly advantageous for an electro-optical device whose circuits on the substrate are all single-channel transistors, or a liquid crystal device using amorphous thin-film transistors (TFTs).

According to a further aspect of the invention, there is provided an electronic apparatus including the above-stated electro-optical device. The electronic apparatus may include, for example, mobile information terminals, mobile telephones, notebook computers, video cameras, and projectors.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
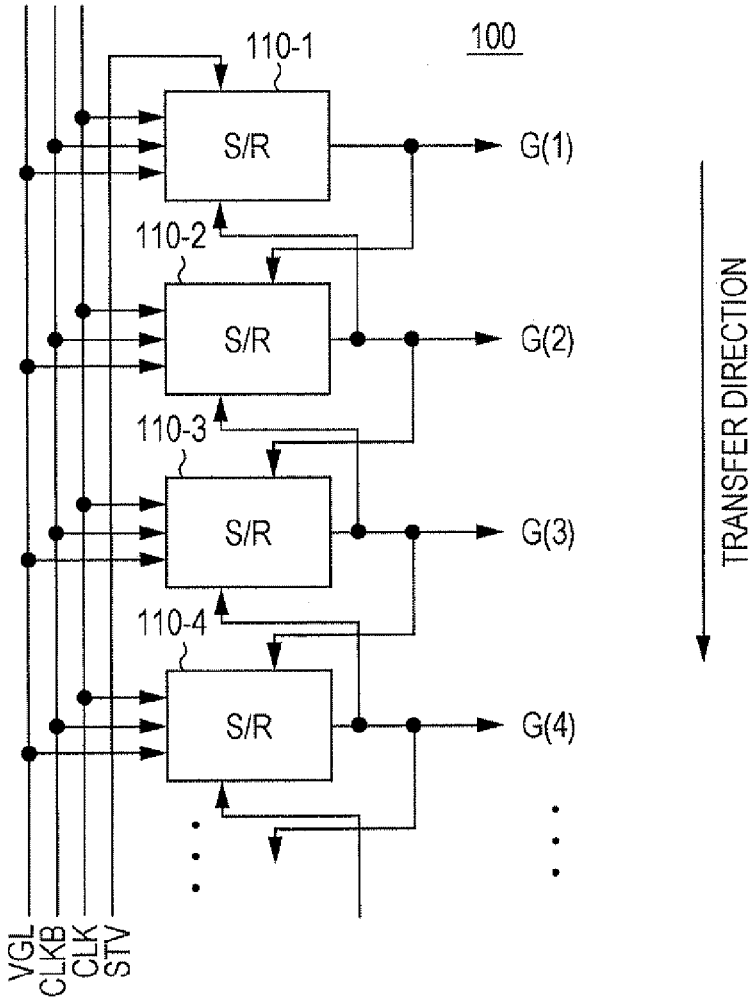
FIG. 1 is a block diagram illustrating the configuration of a shift register that operates in response to two-phase clock signals in accordance with a first embodiment of the invention.

FIG. 1 is a block diagram illustrating the configuration of a shift register 100 that operates in response to two-phase clock signals according to a first embodiment of the invention. The shift register 100 includes, as shown in FIG. 1, a plurality of unit circuits 110 (110-1, 110-2, and so on). A power supply potential VGL, which serves as the reference potential of a low level signal, a clock signal CLK, and an inverted clock signal CLKB out of phase with the clock signal CLK by 180° are supplied to each unit circuit 110.

A start pulse signal STV is supplied to the input terminal of the first unit circuit 110-1, and an output signal G(n−1) of the previous unit circuit 110-(*n*−1) is supplied to the input terminal of each unit circuit 110-*n* except for the first unit circuit 110-1. An output signal G(n+1) of the subsequent unit circuit 110-(*n*+1) is supplied to the control terminal of each unit circuit 110-*n*. With this configuration, in response to the start pulse signal STV input to the first unit circuit 110-1, the shift register 100 sequentially shifts and outputs the output signals G.

Figure 2:
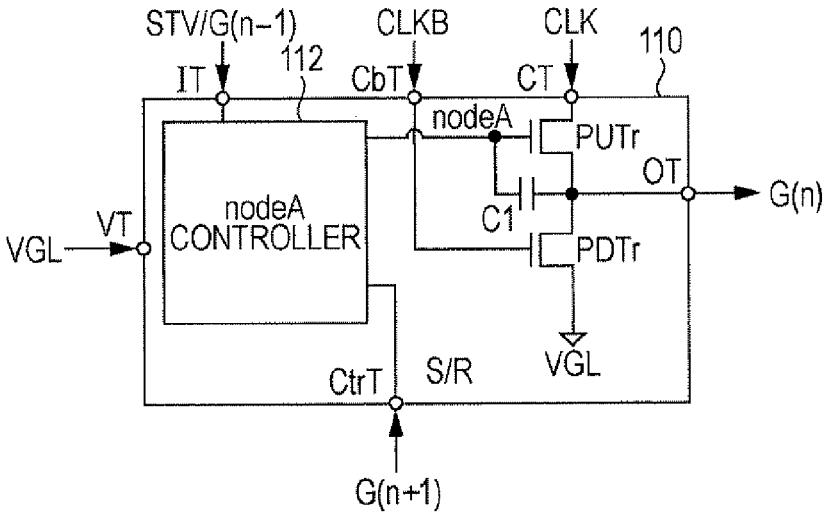
FIG. 2 is a circuit diagram illustrating an example of the configuration of a unit circuit used in the shift register in accordance with the first embodiment of the invention.

FIG. 2 is a circuit diagram illustrating an example of the configuration of the unit circuit 110 according to the first embodiment. The same types of signals and elements as those discussed in the example of the related art are designated with like signs and symbols. The unit circuit 110 includes, as shown in FIG. 2, as external terminals, an input terminal IT, an output terminal OT, a clock input terminal CT (first control terminal), an inverted clock input terminal CbT, a control signal input terminal CtrT, and a power supply terminal VT.

The start pulse signal STV or the output signal G(n−1) of the previous unit circuit 110-(*n*−1) is input to the input terminal IT. The output signal G(n) is output from the output terminal OT. The clock signal CLK is input to the clock input terminal CT, and the inverted clock signal CLKB is input to the inverted clock input terminal CbT. The output signal G(n+1) of the subsequent unit circuit 110-(*n*+1) is input to the control signal input terminal CtrT, and the power supply potential VGL is supplied to the power supply terminal VGL.

The unit circuit 110 includes a pull-up transistor PUTr, a pull-down transistor PDTr, a capacitor C1 and a nodeA controller 112. The nodeA controller 112 generates the potential of the nodeA on the basis of the start pulse signal STV or the output signal G(n−1) of the previous unit circuit 110-(*n*−1), which is input to the input terminal IT, and the output signal G(n+1) of the subsequent unit circuit 110-(*n*+1) supplied to the control signal input terminal CtrT. In this embodiment, the pull-up transistor PUTr is connected at its drain to the clock input terminal CT, and at its source to the output terminal OT. Accordingly, the clock signal CLK input to the clock input terminal CT is supplied to the output terminal OT in the state in which the pull-up transistor PUTr is ON. As discussed below, due to bootstrapping of the capacitor C1, the potential of the nodeA increases to such a degree that it exceeds the drain potential of the pull-up transistor PUTr. Accordingly, the magnitude of the amplitude of the output signal G(n) can be the same as that of the clock signal CLK.

The capacitor C1 is disposed between the source of the pull-up transistor PUTr and the nodeA. As the capacitance of the capacitor C1, stray capacitance of the pull-up transistor PUTr may be used. Alternatively, the capacitance of the capacitor C1 may contain stray capacitance of the pull-up transistor PUTr.

The pull-down transistor PDTr is connected at its gate to the inverted clock input terminal CbT. In this embodiment, the pull-down transistor PDTr is connected at its drain to the output terminal OT, and at its source to the power supply terminal VT. Accordingly, when the inverted clock signal CLKB is made to have a high level, the pull-down transistor PDTr is turned ON so that the potential of the output terminal OT matches the power supply potential VGL, which serves as the reference potential.

In this embodiment, the nodeA controller 112 supplies the start pulse signal STV or the output signal G(n−1) of the previous unit circuit 110-(*n*−1), which is input to the input terminal IT, to the nodeA to control the pull-up transistor PUTr to switch from OFF to ON. Additionally, in response to the output signal G(n+1) of the subsequent unit circuit 110-(*n*+1) input to the control signal input terminal CtrT, the nodeA controller 112 does not immediately turn OFF the pull-up transistor PUTr. Instead, the nodeA controller 112 controls the pull-up transistor PUTr to switch from ON to OFF later than a time at which the output signal G(n+1) is supplied. That is, the nodeA controller 112 delays the time at which the pull-up transistor PUTr is switched from ON to OFF.

Because of this delay, the pull-up transistor PUTr remains ON at the time when the clock signal CLK drops to a low level, thereby maintaining the continuity between the output terminal OT and the clock input terminal CT.

Accordingly, the output signal G(n) when the pull-up transistor PUTr is ON drops immediately to a low level simultaneously with the falling of the clock signal CLK. Thus, even if the pull-down transistor PDTr deteriorates, correct switching of the output levels can be performed. This prevents the occurrence of a period during which both the output signal G(n) and the subsequent output signal G(n+1) are made to have a high level. As a result, the occurrence of erroneous operation in the shift register 100 can be prevented.

With the application of the shift register 100 to, for example, a drive circuit of a display device, the quality of the display device can be maintained even if the pull-down transistor PDTr deteriorates. As a result, the operating life of the device can be prolonged.

Figure 3:
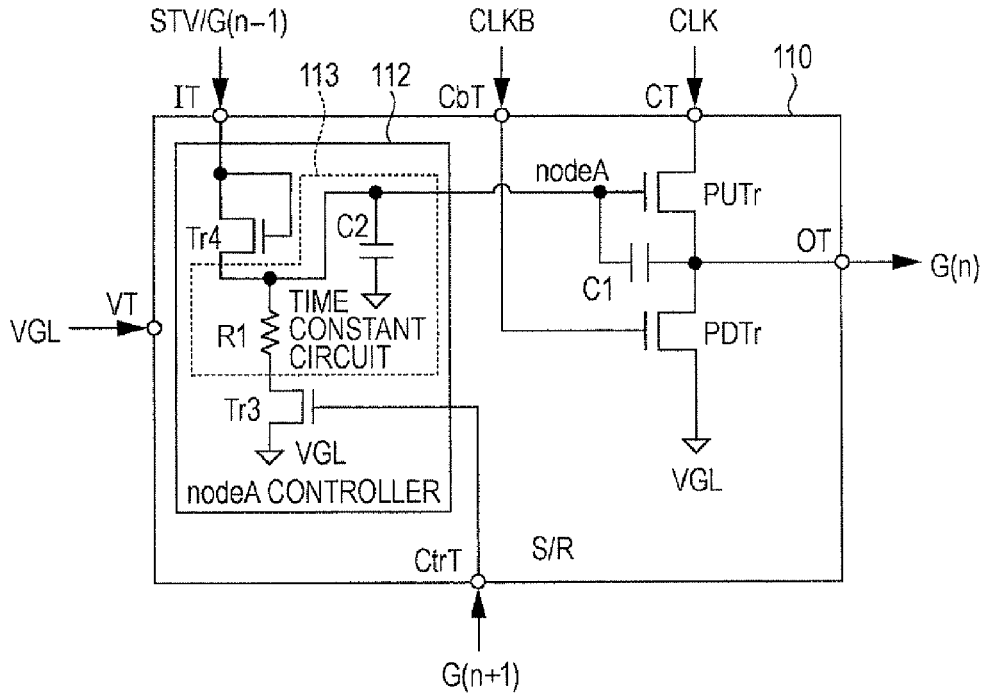
FIG. 3 is a circuit diagram illustrating an example of a nodeA controller used in the unit circuit.

FIG. 3 is a circuit diagram illustrating an example of the nodeA controller 112. The nodeA controller 112 includes, as shown in FIG. 3, a transistor Tr3, a transistor Tr4, and a time constant circuit 113.

The transistor Tr3 is connected at its gate to the control signal input terminal CtrT, at its drain to the nodeA via the time constant circuit 113, and at its source to the power supply terminal VT. In response to the input of the output signal G(n+1) of the subsequent unit circuit 110-(*n*+1), the transistor Tr3 is turned ON so that the potential of the nodeA matches the power supply potential VGL, which serves as the reference potential. The transistor Tr4, which functions as a diode-connected transistor, is disposed between the input terminal IT and the nodeA via the time constant circuit 113.

The time constant circuit 113 includes a capacitor C2 disposed between the nodeA and the fixed potential and a resistor R1 disposed between the nodeA and the drain of the transistor Tr3. The provision of a capacitor only or a resistor only may be sufficient, provided that the capacitor or the resistor can perform an operation comparable to a time constant circuit. The power supply potential VGL may be used as the fixed potential.

Figure 4:
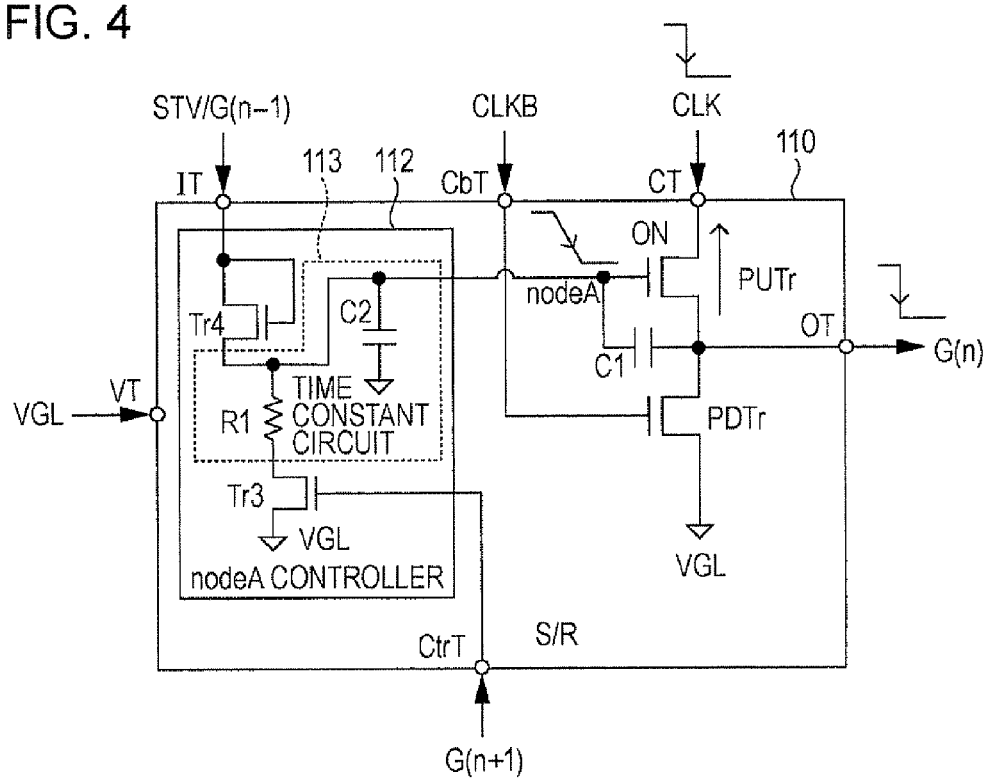
FIG. 4 is a circuit diagram illustrating an operation of a time constant circuit used in the nodeA controller.

When the transistor Tr3 is turned ON in the state in which the capacitor C1 is charged, the potential of the nodeA gradually drops due to the provision of the time constant circuit 113, as schematically shown in FIG. 4. Accordingly, the pull-up transistor PUTr remains ON at the time when the clock signal CLK drops to a low level. That is, in response to the input of the output signal G(n+1) of the subsequent unit circuit 110-(*n*+1), the time constant circuit 113 controls the potential of the nodeA to switch from ON to OFF later than a time at which the output signal G(n+1) is supplied (i.e., the state changes to active). In this sense, the time constant circuit 113 serves as a delay circuit that delays the output signal G(n+1) to control the potential of the nodeA.

Figure 5:
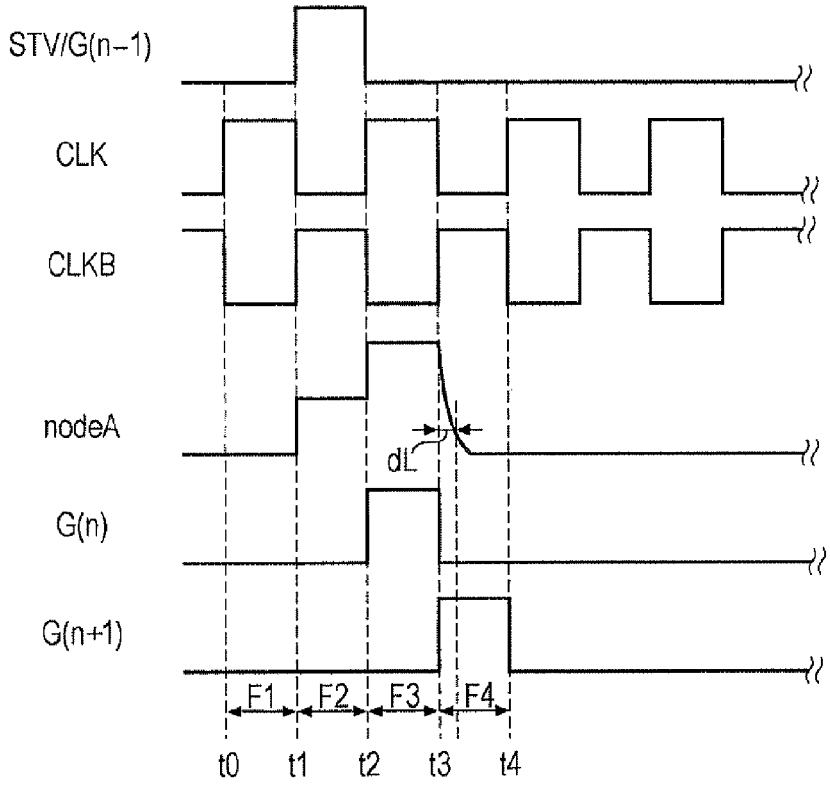
FIG. 5 is a timing chart illustrating an operation of the unit circuit having the nodeA controller shown in FIG. 3.

FIG. 5 is a timing chart illustrating the operation of the unit circuit 110 having the nodeA controller 112 configured as described above. A description is given, assuming that the ON resistance of the pull-down transistor PDTr is increased due to the considerable deterioration thereof.

In FIG. 5, the period F1 from time t0 to time t1 is the initial state in which both the pull-up transistor PUTr and the pull-down transistor PDTr are OFF. The potential of the nodeA is equal to the power supply potential VGL, and the output signal G(n) is maintained at a low level.

At time t1, in response to the start pulse signal STV or the output signal (n−1) of the previous unit circuit 110-(*n*−1), the transistor Tr4 is turned ON. In the period F2, since the inverted clock signal CLKB is at a high level, the pull-down transistor PDTr is turned ON. Accordingly, in the period F2, a current flows in the order of the transistor Tr4, the capacitor C1, and the pull-down transistor PDTr to charge the capacitor C1, which further increases the potential of the nodeA. When the potential of the nodeA exceeds the threshold voltage of the pull-up transistor PUTr, the pull-up transistor PUTr is turned ON. In the period F3, the output signal G(n+1) is changed to a low level, and thus, the transistor Tr3 is turned OFF.

At time t2, the start pulse signal STV or the output signal G(n−1) of the previous unit circuit 110-(*n*−1) shifts to a low level, and the period F3 starts. Then, the transistor Tr4 is turned OFF. Accordingly, the potential of the nodeA is not influenced by the start pulse signal STV or the output signal G(n−1). In the period F3, since the inverted clock signal CLKB is at a low level, the pull-down transistor PDTr is OFF. At time t2, the potential of the nodeA remains at a high level continuously from the period F2, and the pull-up transistor PUTr is maintained in the ON state. At time t2, since the clock signal CLK shifts from a low level to a high level, a current flows into the output terminal OT via the pull-up transistor PUTr. Accordingly, the potential of the nodeA increases in excess of the drain potential due to bootstrapping of the capacitor C1. Thus, the amplitude of the output signal G(n) can match that of the clock signal CLK. The output signal G(n) is input to the subsequent unit circuit 110-(*n*+1).

At time t3, the clock signal CLK is made to have a low level, and the period F4 starts. Then, the inverted clock signal CLKB is made to have a high level, and the pull-down transistor PDTr is turned ON. However, the ON resistance of the pull-down transistor PDTr is increased due to its deterioration over time. Accordingly, even though the pull-down transistor PDTr is turned ON, the potential of the output terminal OT cannot be immediately decreased to the power supply potential VGL. In this embodiment, therefore, an extension of the ON state of the pull-up transistor PUTr compensates for the inconvenience originated from the deterioration of the pull-down transistor PDTr.

At time t3, the output signal G(n+1) of the subsequent unit circuit 110-(*n*+1) is input to the nodeA controller 112 as a control signal to turn ON the transistor Tr3. This starts the discharging of the capacitor C1. At this time, the potential of the nodeA drops, as shown in FIG. 5, due to the function of the time constant circuit 113. When the potential of the nodeA becomes below the threshold voltage of the pull-up transistor PUTr, the pull-up transistor PUTr is turned OFF. Accordingly, the ON state of the pull-up transistor PUTr is extended for a time dL.

Thus, even though the clock signal CLK shifts from a high level to a low level at time t3, the pull-up transistor PUTr is maintained in the ON state. Accordingly, the output signal G(n) can immediately drop to a low level via the pull-up transistor PUTr. In this manner, correct switching of the output levels can be implemented. This can prevent, as shown in FIG. 5, the occurrence of a period during which both the output signal G(n) and the subsequent output signal G(n+1) are simultaneously at a high level. Thus, the occurrence of erroneous operations can be prevented. By rounding the voltage waveform of the nodeA, as stated above, the pull-up transistor PUTr can be maintained in the ON state during the period over which the potential of the nodeA drops from time t3 to such a degree that it reaches the threshold voltage of the pull-up transistor PUTr. In this case, the waveform of the nodeA is rounded to such a degree that the output signal G(n) can be completely shifted to a low level. To achieve this complete transition of the output signal G(n) to a low level, the values of the resistor R1 and the capacitor C2 are determined. The maximum period during which the voltage waveform of the nodeA is rounded is half the period F4 before time t4 in which the clock signal CLK subsequently is made to have a high level.

Figure 6:
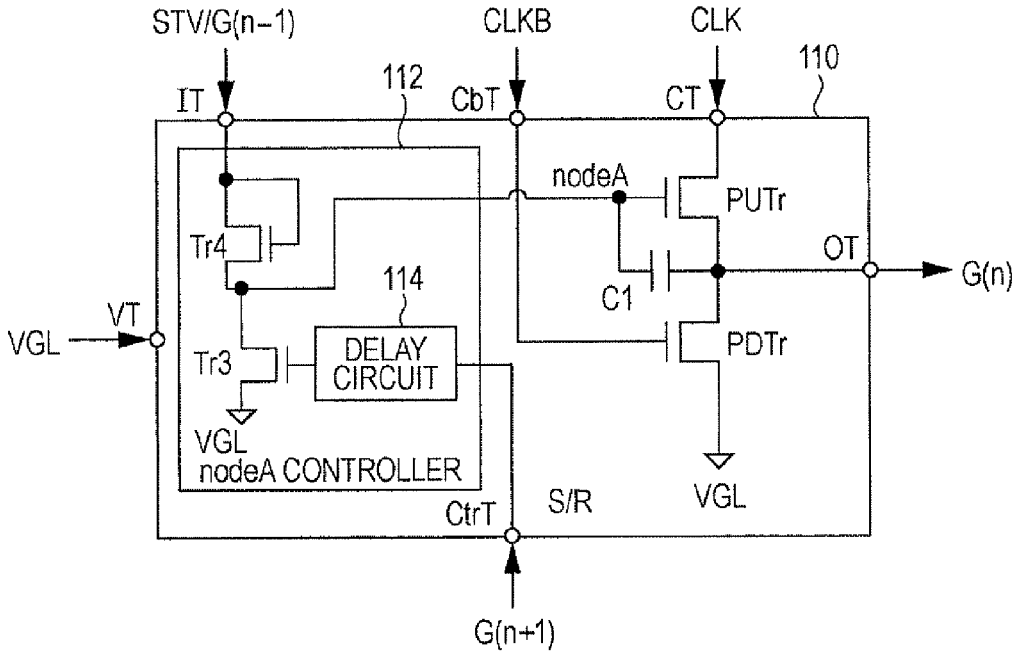
FIG. 6 is a circuit diagram illustrating another example of the nodeA controller.

FIG. 6 is a circuit diagram illustrating another example of the nodeA controller 112. In this example, the nodeA controller 112 includes, as shown in FIG. 6, a transistor Tr3, a transistor Tr4, and a delay circuit 114.

The transistor Tr3 is connected at its gate to the control signal input terminal CtrT via the delay circuit 114, at its drain to the nodeA, and at its source to the power supply terminal VT. In response to the output signal G(n+1) of the subsequent unit circuit 110-(*n*+1), the transistor Tr3 is turned ON so that the potential of the nodeA reaches the power supply potential VGL, which serves as the reference potential. The transistor Tr4, which functions as a diode-connected transistor, is disposed between the input terminal IT and the nodeA.

The delay circuit 114 delays the output signal G(n+1) supplied to the control signal input terminal CtrT for a predetermined time, and then supplies the delayed output signal G(n+1) to the gate of the transistor Tr3. This delays the start of discharging of the capacitor C1. Accordingly, the pull-up transistor PUTr can be maintained in the ON state even when the clock signal CLK drops to a low level.

As stated above, the ON resistance of the pull-down transistor PDTr is increased due to the deterioration of the pull-down transistor PDTr. In this case, the pull-down transistor PDTr cannot drop the output signal G(n) to the power supply potential VGL for a certain period of time. Even in this case, due to the operation of the pull-up transistor PUTr, the output signal G(n) immediately drops to the power supply potential VGL.

Figures 7A, 7B:
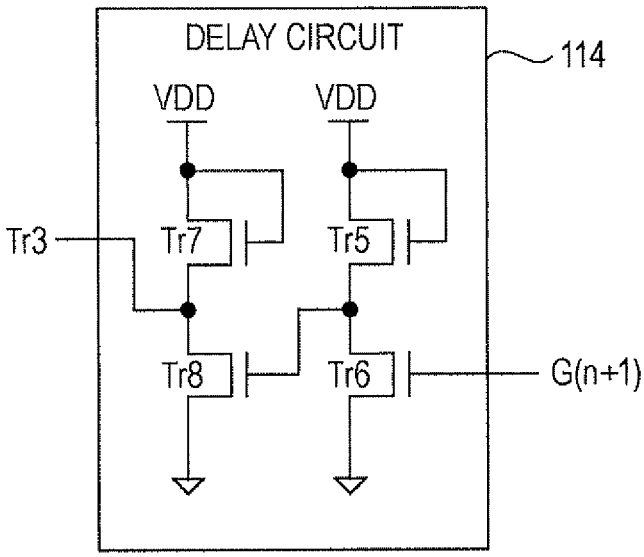
FIGS. 7A and 7B are respectively a circuit diagram and an operation table illustrating the circuit configuration and the operation of a delay circuit.

FIGS. 7A and 7B respectively illustrate examples of the circuit configuration and the operation of the delay circuit 114. The delay circuit 114 is formed by, as shown in FIG. 7A, connecting an inverter including transistors Try and Tr6 and an inverter including transistors Tr7 and Tr8. The inverters do not have to be two inverters, and may have a desired even number of inverters to adjust the delay time. Alternatively, instead of inverters, another type of circuit may be used to form the delay circuit 114.

In operation, as shown in FIG. 7B, when the output signal G(n+1) of the subsequent unit circuit 110-(*n*+1) is at a low level, the output of the delay circuit 114 is also made to have a low level, and thus, the transistor Tr3 remains OFF. When the output signal G(n+1) shifts to a high level, the transistor Tr6 is turned ON, and then, the transistor Tr8 is turned OFF, further turning ON the transistor Tr3. In operation as described above, the delay circuit 114 delays the time at which the transistor Tr3 is switched from OFF to ON from the input time of the output signal G(n+1). As a result, the ON state of the pull-up transistor PUTr can be extended.

Figure 8:
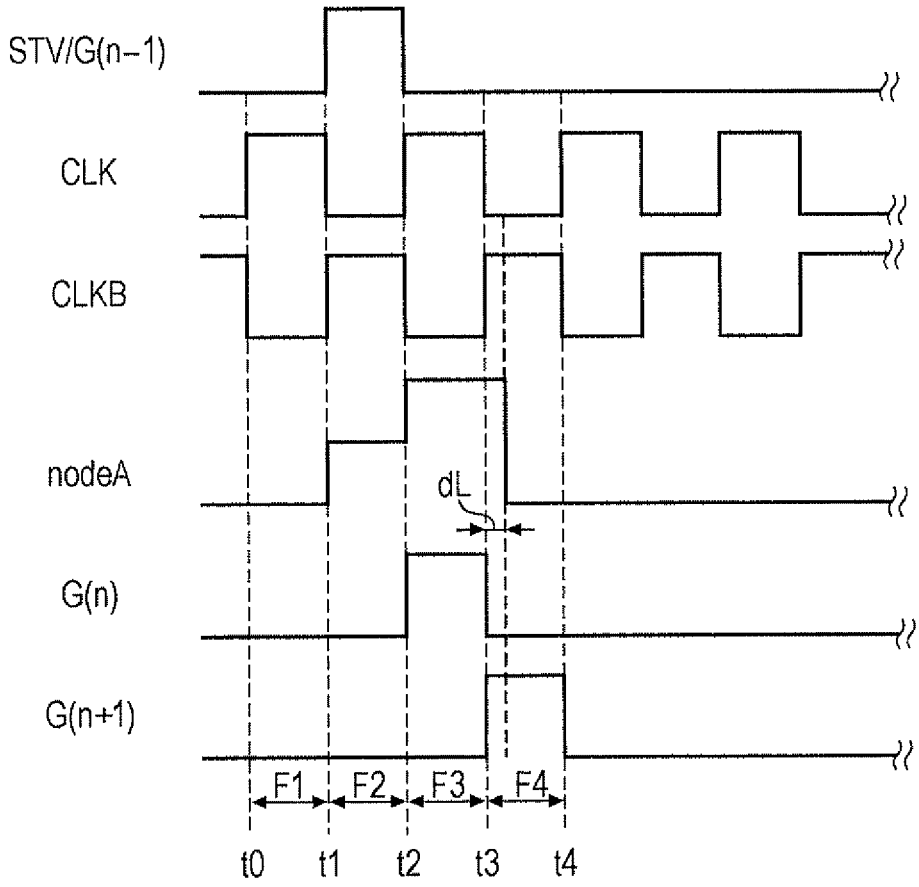
FIG. 8 is a timing chart illustrating an operation of the unit circuit having the nodeA controller shown in FIG. 6.

FIG. 8 is a timing chart illustrating the unit circuit 110 shown in FIG. 6. A description is also given, assuming that the pull-down transistor PDTr has deteriorated over time.

In FIG. 8, the period F1 from time t0 to time t1 is the initial state in which both the pull-up transistor PUTr and the pull-down transistor PDTr are OFF. The potential of the nodeA is equal to the power supply potential VGL, and the output signal G(n) is maintained at a low level.

At time t1, in response to the start pulse signal STV or the output signal G(n−1) of the previous unit circuit 110-(*n*−1), the transistor Tr4 is turned ON. In the period F2, since the inverted clock signal CLKB is at a high level, the pull-down transistor PDTr is turned ON. Accordingly, in the period F2, a current flows in the order of the transistor Tr4, the capacitor C1, and the pull-down transistor PDTr to charge the capacitor C1, which further increases the potential of the nodeA. When the potential of the nodeA exceeds the threshold voltage of the pull-up transistor PUTr, the pull-up transistor PUTr is turned ON. In the period F3, the output signal G(n+1) is at a low level, and thus, the transistor Tri is turned OFF.

At time t2, the start pulse signal STV or the output signal G(n−1) of the previous unit circuit 110-(*n*−1) shifts to a low level. Since the transistor Tr4 is turned OFF, the potential of the nodeA is not influenced by the start pulse signal STV or the output signal G(n−1). The clock signal CLK shifts from a low level to a high level, causing the potential of the output terminal OT to increase via the pull-up transistor PUTr. Accordingly, the potential of the nodeA increases in excess of the drain potential due to bootstrapping of the capacitor C1. Thus, the amplitude of the output signal G(n) can match that of the clock signal CLK.

At time t3, the clock signal CLK is made to have a low level, and the inverted clock signal CLKB is made to have a high level. Then, the pull-down transistor PDTr is turned ON.

At time t3, the output signal G(n+1) of the subsequent unit circuit 110-(*n*+1) is input to the nodeA controller 112 as a control signal. The control signal is delayed for a time dL by the delay circuit 114 and is then supplied to the transistor Tr3. The transistor Tr3 is then turned ON. Accordingly, discharging of the capacitor C1 is started with a delay equal to the time dL from time t3. Thus, the potential of the nodeA does not change at time t3, and shifts to a low level after the lapse of the time dL from t3. As a result, the ON state of the pull-up transistor PUTr is extended for a time dL.

Thus, because of the extension of the ON state of the pull-up transistor PUTr, the output signal G(n) can immediately drop to a low level when the clock signal CLK switches to a low level at time t3. In this manner, correct switching of the output levels can be implemented. This can prevent, as shown in FIG. 8, the occurrence of a period during which both the output signal G(n) and the subsequent output signal G(n+1) are simultaneously at a high level. Thus, the occurrence of erroneous operations can be prevented.

According to the foregoing first embodiment, when the output signal G(n+1) of the subsequent unit circuit 110-(*n*+1) is input to the control signal input terminal CtrT, the nodeA controller 112 controls the pull-up transistor PUTr to switch from ON to OFF later than a time at which the output signal G(n+1) is supplied. The configuration of the circuit that can implement this is not restricted to the time constant circuit 113 or the delay circuit 114 discussed above. In short, any configuration may be taken as long as the time at which the pull-up transistor PUTr is turned OFF is delayed.

Second Embodiment

An electro-optical device 500 using the above-described shift register 100 for a drive circuit is described below.

Figure 9:
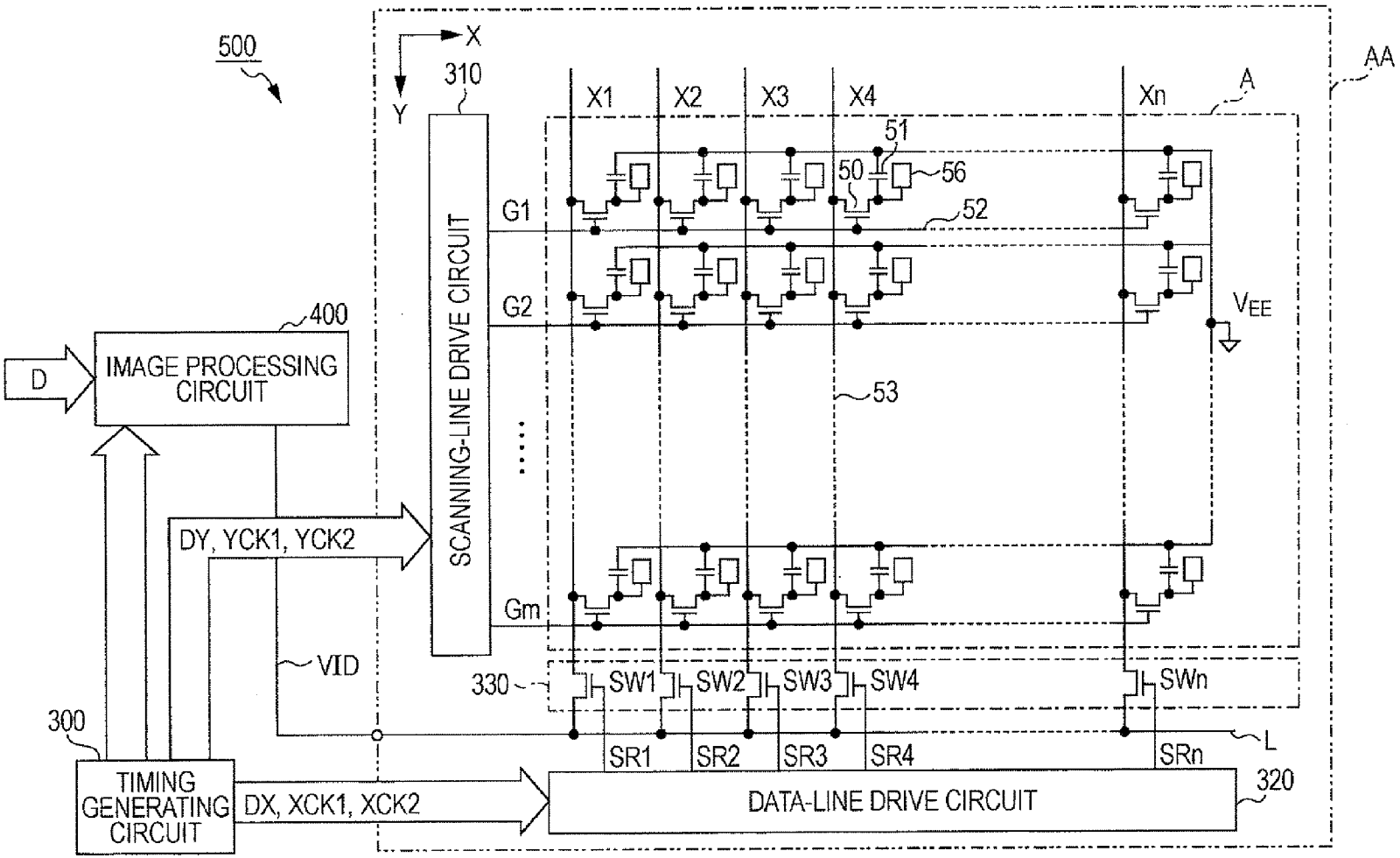
FIG. 9 is a block diagram illustrating the electrical configuration of an electro-optical device in accordance with a second embodiment of the invention.

FIG. 9 is a block diagram illustrating the electrical configuration of the electro-optical device 500 according to a second embodiment of the invention. The electro-optical device 500 employs liquid crystals as an electro-optical material. The electro-optical device 500 includes a liquid crystal panel AA as the main unit. The liquid crystal panel AA includes a device substrate on which thin-film transistors (hereinafter referred to as the "TFTs") are formed as switching elements and a counter substrate. The device substrate and the counter substrate face each other with a predetermined gap therebetween, and the liquid crystals are interposed in this gap.

The electro-optical device 500 includes the liquid crystal panel AA, a timing generating circuit 300, and an image processing circuit 400. The liquid crystal panel AA includes, on the device substrate, an image display area A, a scanning-line drive circuit 310, a data-line drive circuit 320, a sampling circuit 330, and an image signal supply line L. Input image data D to be supplied to the electro-optical device 500 is, for example, three-bit parallel data. In synchronization with the input image data D, the timing generating circuit 300 generates a first Y clock signal YCK1, a second Y clock signal YCK2, a first X clock signal XCK1, a second X clock signal XCK2, a Y transfer start pulse DY, and an X transfer start pulse DX, and suitably supplies those signals to the scanning-line drive circuit 310 and the data-line drive circuit 320. The timing generating circuit 300 also generates various timing signals that control the image processing circuit 400, and outputs the generated timing signals. The Y transfer start pulse DY is a pulse that instructs the scanning-line drive circuit 310 to select scanning lines 52, while the X transfer start pulse DX is a pulse that instructs the data line drive circuit 320 to select data lines 53.

The image processing circuit 400 conducts gamma correction on the input image data D in consideration of the light transmittance of the liquid crystal panel AA. The image processing circuit 400 then performs digital-to-analog conversion on the image data of R, G, and B colors to generate an image signal VID, and then supplies the generated image signal VID to the liquid crystal panel AA.

In the image display area A, as shown in FIG. 9, m (m is a natural number of two or more) of scanning lines 52 are formed in parallel in the X direction, while n (n is a natural number of two or more) data lines 53 are formed in parallel in the Y direction. A TFT 50 is formed at an intersection of the corresponding scanning line 52 and the corresponding data line 53. The TFT 50 is connected at its gate to the scanning line 52, at its source to the data line 53, and its drain to an image electrode 56. Each pixel is formed of the image electrode 56, a counter electrode disposed on the counter substrate, and a liquid crystal interposed between the pixel electrode 56 and the counter electrode. As a result, the pixels are disposed in a matrix form in correspondence with the intersections of the scanning lines 52 and the data lines 53.

Scanning signals G1 through Gm are line-sequentially applied in a pulsating manner to the corresponding scanning lines 52 connected to the gates of the TFTs 50. Accordingly, when a scanning signal is supplied to a certain scanning line 52, the TFT 50 connected to that scanning line 52 is turned ON. Thus, image signals X1 through Xn supplied from the data lines 53 at predetermined times are sequentially written into the corresponding pixels and are retained for a predetermined period.

In the above-configured electro-optical device 500, the shift registers 100 discussed in the first embodiment can be used for the scanning-line drive circuit 310 and the data-line drive circuit 320. In a case where the shift register 100 is used for the scanning-line drive circuit 310, the first Y clock signal YCK1 and the second Y clock signal YCK2 are used as the first clock signal CK1 and the second clock signal CK2, respectively, and the Y transfer start pulse DY is used as the start pulse signal STV. In a case where the shift register 100 is used for the data-line drive circuit 320, the first X clock signal XCK1 and the second X clock signal XCK2 are used as the first clock signal CK1 and the second clock signal CK2, respectively, and the X transfer start pulse DX is used as the start pulse signal STV.

The electro-optical device 500 described above is a liquid crystal display device using liquid crystals as the electro-optical material. This liquid crystal display device may be a transmissive type, a reflective type, or a transflective type. The liquid crystal display device may be an active matrix type or a passive matrix type. The electro-optical device 500 may be applicable to various types of devices, such as an organic EL device, a florescent display tube, a plasma display panel, or a digital mirror device.

Electronic Apparatus

Examples of electronic apparatuses using the electro-optical device 500 are described below.

Figure 10:
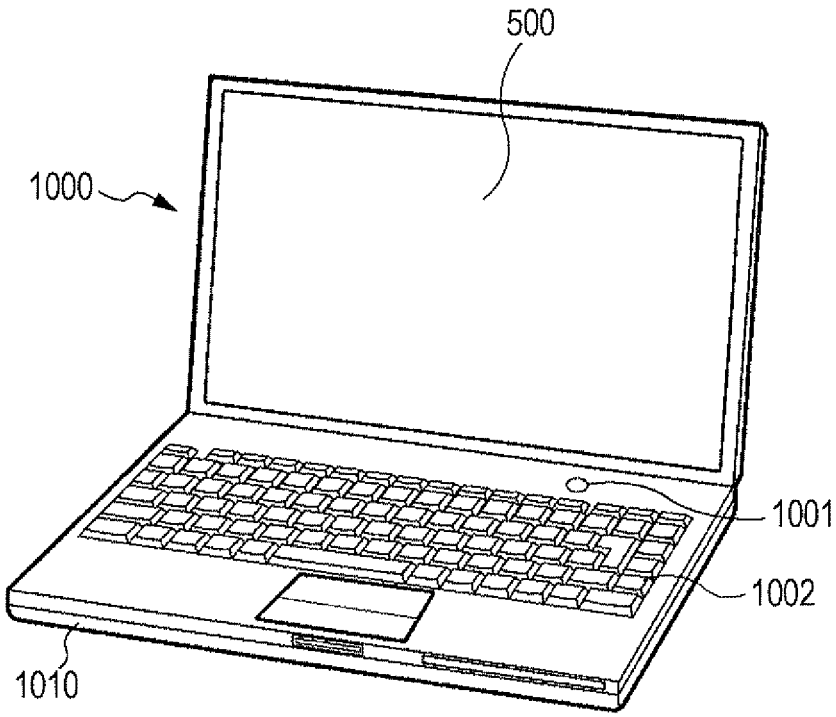
FIG. 10 is a perspective view illustrating a personal computer, which is an example of an electronic apparatus using the electro-optical device, in accordance with an embodiment of the invention.

FIG. 10 illustrates the configuration of a mobile personal computer 1000 using the electro-optical device 500. The personal computer 1000 includes the electro-optical device 500, which serves as a display unit, and a main unit 1010. The main unit 1010 includes a power switch 1001 and a keyboard 1002.

Figure 11:
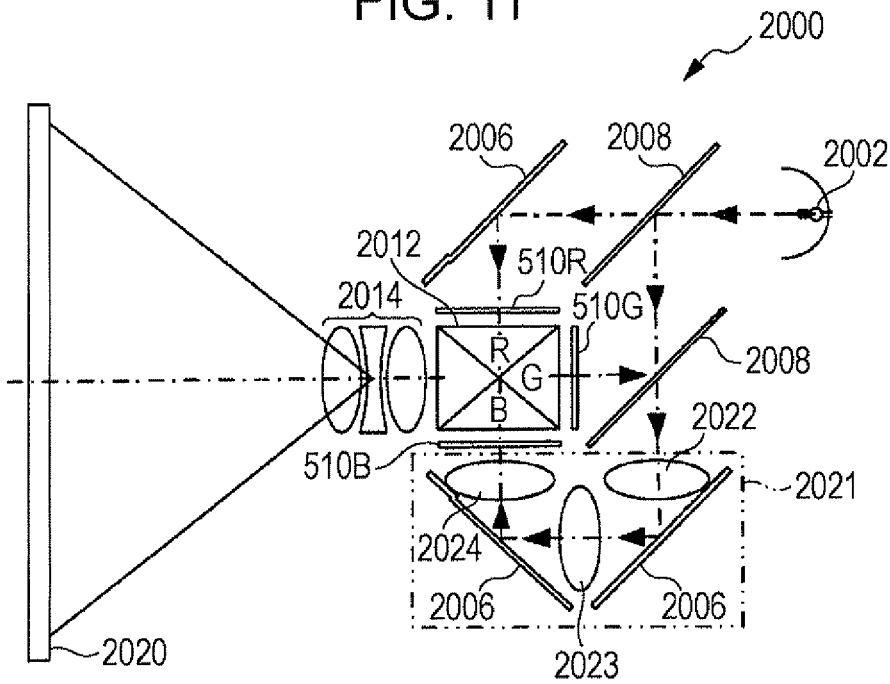
FIG. 11 is a block diagram illustrating a projector, which is an example of an electronic apparatus using the electro-optical device, in accordance with an embodiment of the invention.

FIG. 11 illustrates the configuration of a projector 2000 using the electro-optical device 500. The projector 2000 includes therein, as shown in FIG. 11, a lamp unit 2002 having a white light source, such as a halogen lamp. Projection light emitted from the lamp unit 2002 is separated, by three mirrors 2006 and two dichroic mirrors 2008 disposed within the projector 2000, into light components red (R), green (G), and blue (B) corresponding to the three primary colors. The separated light components R, G, and B are input to light valves 5108, 510G, and 51013, respectively. The light valves 510R, 510G, and 510B are basically the same as the electro-optical device 500 of the second embodiment, i.e., a transmissive-type liquid crystal device. That is, the light valves 510R, 510G, and 510B function as optical modulators that generate images of the three primary R, G, and B colors, respectively. The optical path of the light component B is longer than that of the light component R or G. Accordingly, in order to prevent the loss of the light component B, the light component B is input after passing through a relay lens system 2021 including an incident lens 2022, a relay lens 2023, and an emission lens 2024. The light components R, G, and B modulated by the light valves 510R, 510G, and 510B, respectively, are incident on a dichroic prism 2012 from three directions. Then, the R and B light components are refracted at 90 degrees on the dichroic prism 2012, while the G light component passes straight through the dichroic prism 2012. Thus, a color image synthesized from the images corresponding to the three primary colors R, G, and B is projected on a screen 2020 via a projection lens 2014.

Figure 12:
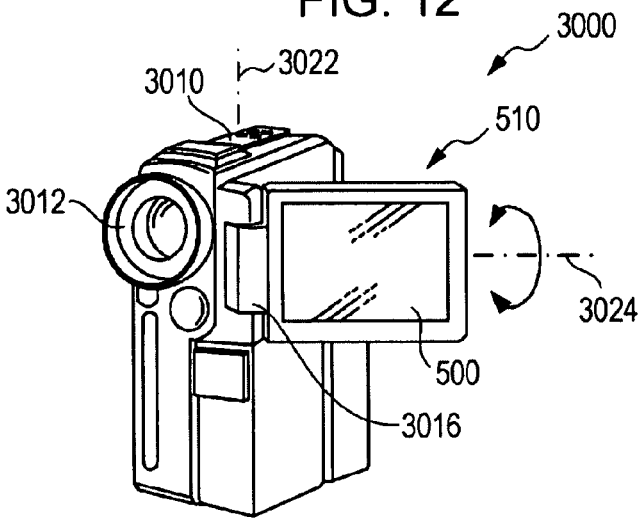
FIG. 12 is a block diagram illustrating a video camera, which is an example of an electronic apparatus using the electro-optical device, in accordance with an embodiment of the invention.
Figure 13:
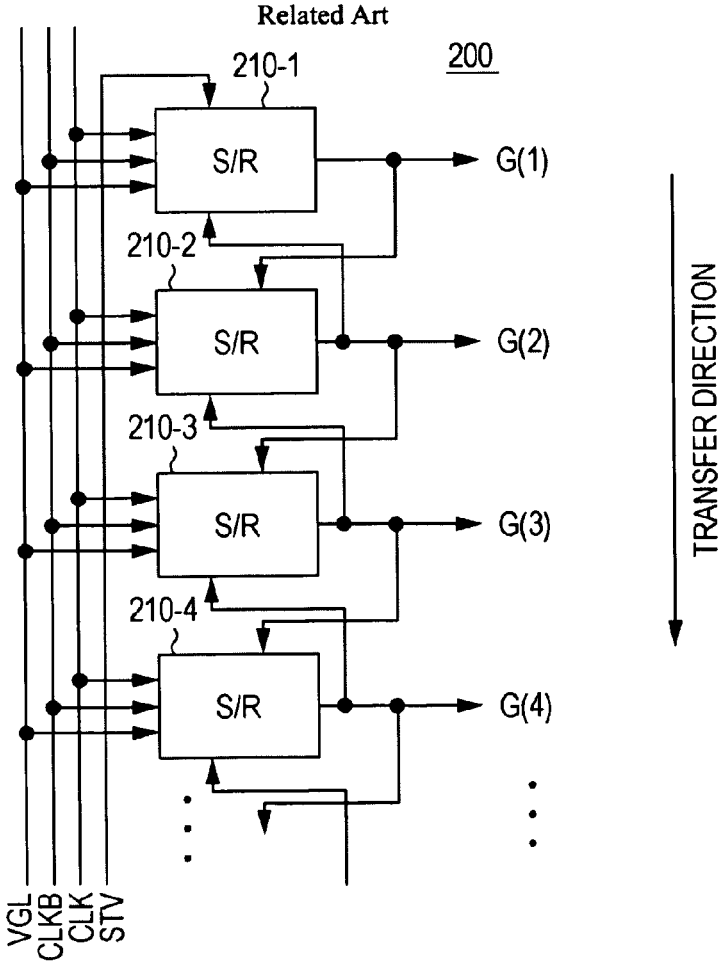
FIG. 13 Related Art
FIG. 13 is a block diagram illustrating the configuration of a shift register that operates in response to two-phase clock signals.
Figure 14:
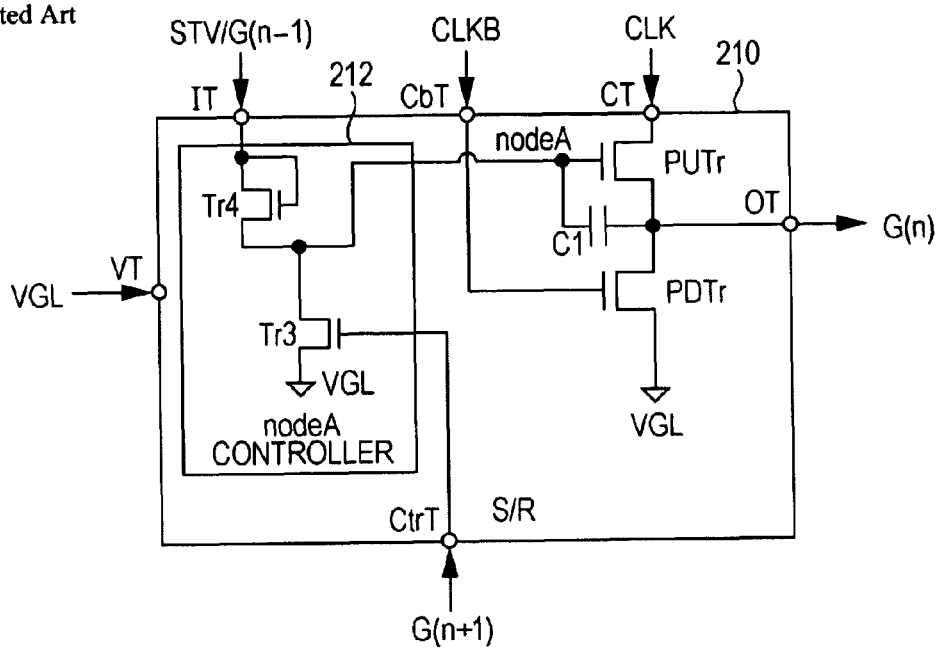
FIG. 14 Related Art
FIG. 14 is a circuit diagram illustrating an example of the configuration of a unit circuit.
Figure 15:
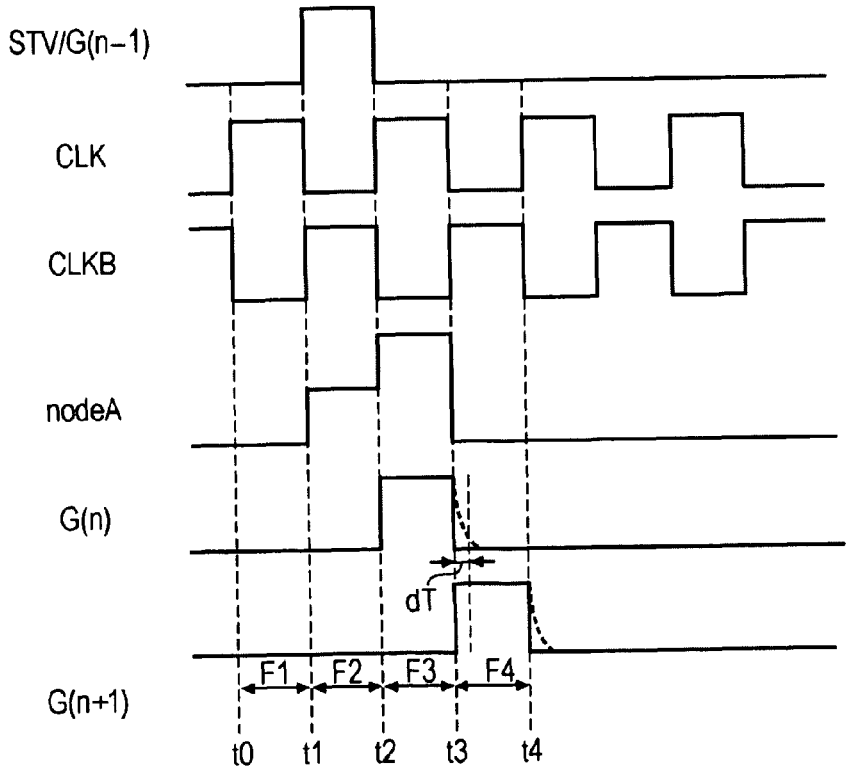
FIG. 15 Related Art
FIG. 15 is a timing chart illustrating the operation of the unit circuit shown in FIG. 14.

FIG. 12 illustrates the configuration of a video camera 3000 using the electro-optical device 500. The video camera 3000 includes, as shown in FIG. 12, the electro-optical device 500, which is used as a monitor 510, and an optical system 3012. The electro-optical device 500 is pivotally attached to a hinge 3016 around an axis 3024, and also pivotally attached to the hinge 3016 such that it can be opened and closed with respect to a main unit 3010 around an axis 3022.

Thus, when using the electro-optical device 500, the following two modes are possible. In one mode, a photographer views an image at an angle as shown in FIG. 12, and in another mode, a photographer uses a finder at the back of the video camera (backward of FIG. 12). When using the electro-optical device 500 in these two modes, it is necessary that a display image be inverted vertically and horizontally. In this case, using the shift register 100 in each of the scanning-line drive circuit 310 and the data-line drive circuit 320, the vertical scanning direction of the scanning-line drive circuit 310 and the horizontal scanning direction of the data-line drive circuit 320 in one mode are inverted from those in the other mode. Then, a display image can be vertically and horizontally inverted.

Electronic apparatuses using the electro-optical device 500 are not restricted to those shown in FIGS. 10 through 12. Alternatively, they may include digital still cameras, liquid crystal televisions, view finders, direct-monitoring-type video cassette recorders, car navigation systems, pagers, digital diaries, electronic calculators, word-processors, workstations, videophones, point-of-sale (POS) terminals, devices including touch panels, and so on.

The entire disclosure of Japanese Patent Application No. 2010-72345, filed Mar. 26, 2010 is expressly incorporated by reference herein.

What is claimed is:

1. A shift register comprising a plurality of unit circuits connected in series, each of the plurality of unit circuits including an input terminal and an output terminal, the shift register sequentially transferring a start signal supplied to the input terminal of a first one of the unit circuits in synchronization with a clock signal and an inverted clock signal whose phases are opposite to each other, each of the plurality of unit circuits including:

a first control terminal to which the clock signal is supplied;

a second control terminal to which the inverted clock signal is supplied;

a third control terminal to which an output signal output from the output terminal of a subsequent unit circuit is supplied;

a power supply terminal to which a power supply potential is supplied;

a first transistor disposed between the first control terminal and the output terminal;

a second transistor disposed between the output terminal and the power supply terminal and connected at a gate of the second transistor to the second control terminal;

a first capacitor disposed between the output terminal and a gate of the first transistor; and a controller that supplies the start signal or the output signal of a previous unit circuit supplied through the input terminal to the gate of the first transistor so as to connect the first control terminal to the output terminal, and that supplies the output signal of the subsequent unit circuit input to the third control terminal to control a potential applied to the gate of the first transistor to switch the first transistor from on to off at a controlled time later than a time at which the output signal of the subsequent unit circuit is supplied to the third control terminal so as to connect the first control terminal and the power supply terminal to the output terminal, wherein the controller includes:

a third transistor that connects the gate of the first transistor to the power supply terminal when the output signal of the subsequent unit circuit is supplied to a gate of the third transistor; and a time constant circuit disposed between the gate of the first transistor and the third transistor.

2. The shift register according to claim 1, wherein the time constant circuit includes:

a second capacitor that is connected at one electrode of the second capacitor to the gate of the first transistor and that receives a fixed potential at the other electrode of the second capacitor; and a resistor disposed between the third transistor and the gate of the first transistor.

3. The shift register according to claim 1, wherein the controller includes:

a third transistor that connects the gate of the first transistor to the power supply terminal when the output signal of the subsequent unit circuit is supplied to a gate of the third transistor; and a delay circuit disposed between the gate of the third transistor and the third control terminal.

4. The shift register according to claim 3, wherein the delay circuit includes an even-numbered plurality of multistage-connected inverters.

5. The shift register according to claim 1, wherein the first capacitor is formed of stray capacitance of the first transistor or includes the stray capacitance.

6. A scanning-line drive circuit used in an electro-optical device including a plurality of scanning lines, a plurality of data lines, and electro-optical elements disposed in correspondence with intersections of the scanning lines and the data lines, the scanning-line drive circuit comprising the shift register according to claim 1, wherein the scanning-line drive circuit generates, on the basis of the output signals generated by transferring the start signal by using the shift register, a plurality of scanning signals for sequentially selecting the plurality of scanning lines exclusively.

7. An electro-optical device comprising:

a plurality of scanning lines;

a plurality of data lines;

electro-optical elements disposed in correspondence with intersections of the scanning lines and the data lines; and the scanning-line drive circuit according to claim 6.

8. An electronic apparatus comprising the electro-optical device according to claim 7.

9. A data-line drive circuit used in an electro-optical device including a plurality of scanning lines, a plurality of data lines, and electro-optical elements disposed in correspondence with intersections of the scanning lines and the data lines, the data-line drive circuit comprising the shift register according to claim 1, wherein the data-line drive circuit generates, on the basis of the output signals generated by transferring the start signal by using the shift register, a plurality of data-line selecting signals for sequentially selecting the plurality of data lines exclusively.

10. An electro-optical device comprising:

a plurality of scanning lines;

a plurality of data lines;

electro-optical elements disposed in correspondence with intersections of the scanning lines and the data lines; and the data-line drive circuit according to claim 9.

* * * * *